US006053370A

United States Patent [19]

Ludbrook et al.

[11] Patent Number: 6,053,370

[45] Date of Patent: Apr. 25, 2000

[54] FLUID DISPENSING VALVE ASSEMBLY

[75] Inventors: Gregory S. Ludbrook, Glendale; Edward R. Stevens, Jr., St. Charles, both of Mo.

[73] Assignee: Koller Enterprises, Inc., Fenton, Mo.

[21] Appl. No.: 09/088,830

[22] Filed: Jun. 2, 1998

[51] Int. Cl.[7] ..... B65D 37/00

[52] U.S. Cl. ..... 222/207; 222/181.3; 222/209; 222/494

[58] Field of Search ..... 222/181.1, 181.3, 222/207, 209, 494

[56] References Cited

U.S. PATENT DOCUMENTS

| | | | |
|---|---|---|---|
| 847,722 | 3/1907 | Bender . | |
| 920,931 | 5/1909 | Donnelly . | |
| 1,164,754 | 12/1915 | Rose . | |
| 1,174,674 | 3/1916 | Byer . | |
| 1,187,474 | 6/1916 | Hollingsworth . | |
| 1,392,601 | 10/1921 | Rose . | |
| 1,844,557 | 2/1932 | Bobrick . | |
| 2,233,818 | 3/1941 | Matter | 137/34.2 |
| 2,283,529 | 5/1942 | Bobrick | 221/102 |
| 2,554,570 | 5/1951 | Harvey | 222/207 |
| 2,772,817 | 12/1956 | Jauch | 222/207 |
| 2,814,419 | 11/1957 | Lipman | 222/207 |
| 3,124,275 | 3/1964 | Lake | 222/182 |
| 3,142,415 | 7/1964 | Louchheim | 221/96 |
| 3,254,802 | 6/1966 | Barnes | 222/181 |
| 3,828,985 | 8/1974 | Schindler | 222/207 |
| 4,085,867 | 4/1978 | Heller | 222/181 |
| 4,133,457 | 1/1979 | Klassen | 222/212 |
| 4,155,487 | 5/1979 | Blake | 222/207 |
| 4,168,020 | 9/1979 | Benson | 222/207 |
| 4,222,501 | 9/1980 | Hammett et al. | 222/207 |
| 4,315,582 | 2/1982 | Micallef | 222/148 |
| 4,515,294 | 5/1985 | Udall | 222/105 |
| 4,646,945 | 3/1987 | Steiner et al. | 222/207 |
| 4,705,195 | 11/1987 | Heck | 222/207 |
| 4,863,070 | 9/1989 | Andris | 222/207 |
| 4,978,036 | 12/1990 | Burd | 222/181.3 |
| 4,993,600 | 2/1991 | Tucker et al. | 222/181.3 |
| 5,238,156 | 8/1993 | Andris | 222/207 |
| 5,303,867 | 4/1994 | Peterson | 239/333 |
| 5,306,125 | 4/1994 | Weag | 417/472 |
| 5,636,765 | 6/1997 | DeJonge | 222/207 |
| 5,664,703 | 9/1997 | Reifenberger et al. | 222/207 |
| 5,836,482 | 11/1998 | Ophardt et al. | 222/181.1 |

FOREIGN PATENT DOCUMENTS 2727679 11/1978 Germany .

*Primary Examiner*—Joseph A. Kaufman

*Attorney, Agent, or Firm*—Senniger, Powers, Leavitt & Roedel

[57] ABSTRACT

A dispenser for dispensing charges of fluid from a container and applicable to a mouth of the container with the container in an inverted position and the mouth down. The dispenser includes a body formed of resilient elastomeric material having a hollow annular upper part having a flexible, resilient annular wall and an upper and lower end and constituting a bellows which is downwardly expansible and upwardly contractible by flexing of the annular wall. The body has integral with the bellows a lower part having a discharge port. The dispenser includes a first check valve at an entry end of the bellows operable for flow of fluid into the bellows on expansion thereof and operable to block flow of fluid from the pump member out of its upper end on contraction thereof. A second valve is operable for dispensing the charge of fluid from the bellows down into the outlet nozzle on contraction of the bellows and to block flow out of the bellows outlet on expansion of the bellows. The second check valve has a valve seat member at the intake of the bellows and outlet nozzle, has at least one outlet port below the valve and a spring biased to keep the poppet valve seated against the valve seat such that the fluid is expelled through the poppet valve, outlet nozzle, and outlet port on contraction of the pump member.

11 Claims, 4 Drawing Sheets

FLUID DISPENSING VALVE ASSEMBLY

BRIEF SUMMARY OF THE INVENTION

This invention relates generally to fluid dispensing valves and more particularly to dispensing valves of the type suitable for dispensing fluids such as soaps, hand cleaners and lotions. Such dispensers include either expensive devices for dispensing the fluid or simple devices that do not provide reliable use over an extended period of time. Many dispensing valves fail over time due to warpage of internal parts which results in excessive leakage of the fluid creating a mess under the dispenser. It is further desirable to easily replace the valve if the valve becomes damaged without discarding the entire fluid dispenser.

Accordingly, among the several objects of this invention may be noted the provision of a dispenser that dispenses a pre-determined amount of fluid upon each actuation and which is reliable over an extended period of time and readily replaceable; and the provision of such a dispenser which is economical to manufacture and easy to use.

Generally, a dispensing valve assembly of this invention is connectable to a container for dispensing fluid from the container. The valve assembly comprises a bellows capable of movement between an expanded configuration and a collapsed configuration. The bellows has an inlet for fluid communication with the container for receiving fluid into the bellows upon movement of the bellows to its expanded configuration. The bellows has an outlet for exhausting fluid from the bellows upon movement of the bellows to its collapsed configuration. The valve assembly further comprises an outlet nozzle connected to the bellows. The outlet nozzle is in fluid communication with the outlet of the bellows for receiving fluid exhausted from the bellows and dispensing fluid from the dispenser. The bellows and the outlet nozzle are of unitary construction and formed of an elastomeric material. The valve assembly further comprises a first check valve for regulating the flow of fluid between the container and the bellows and a second check valve for regulating the flow of fluid between the bellows and the outlet nozzle.

Other objects and features will be in part apparent and in part pointed out hereinafter.

BRIEF DESCRIPTION OF THE DRAWINGS

Corresponding parts are designated by corresponding reference numerals in the several views of the drawings.

DETAILED DESCRIPTION OF THE PREFERRED EMBODIMENT

Figure 1:
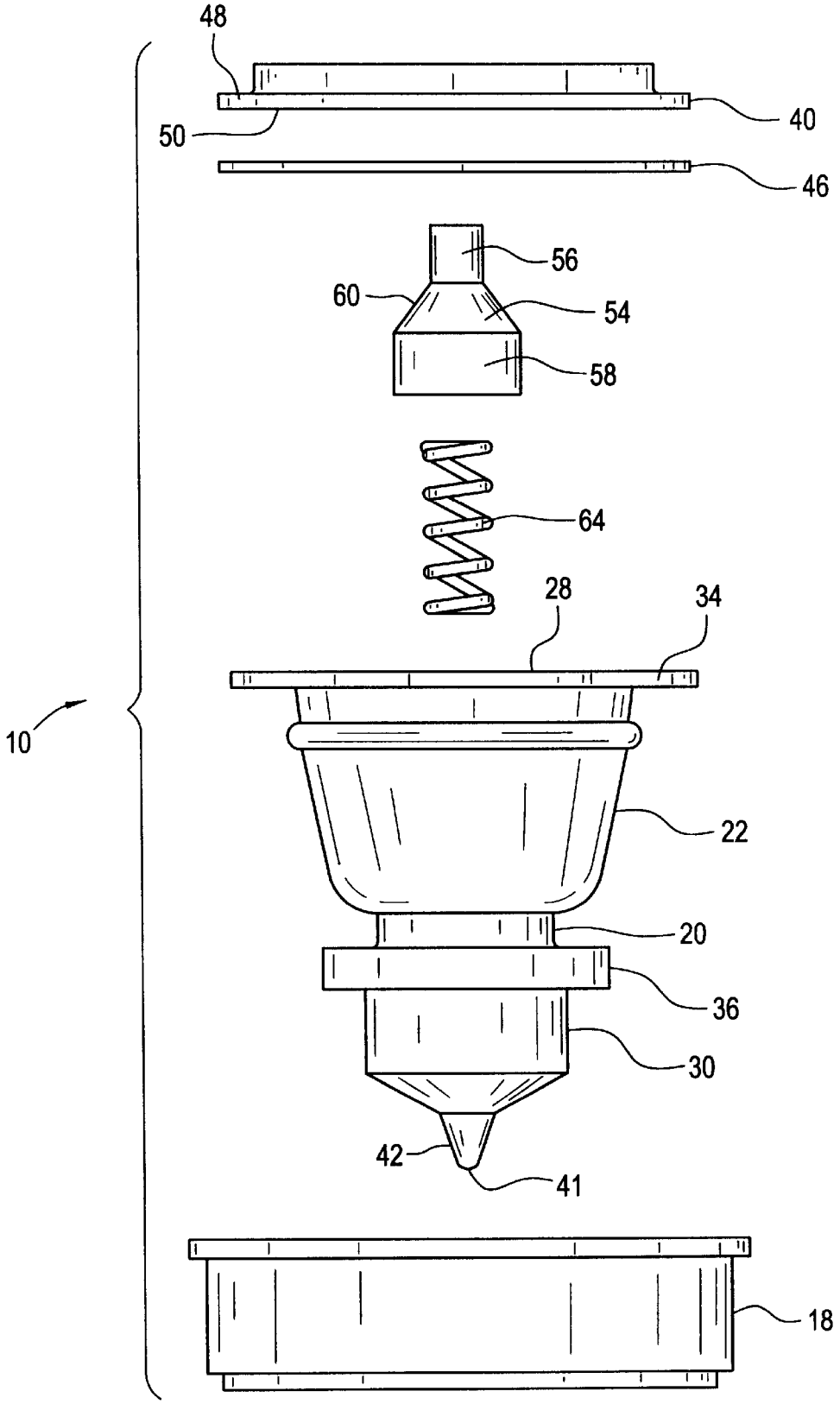
FIG. 1 is an exploded view of a fluid dispenser of the present invention.
Figure 2:
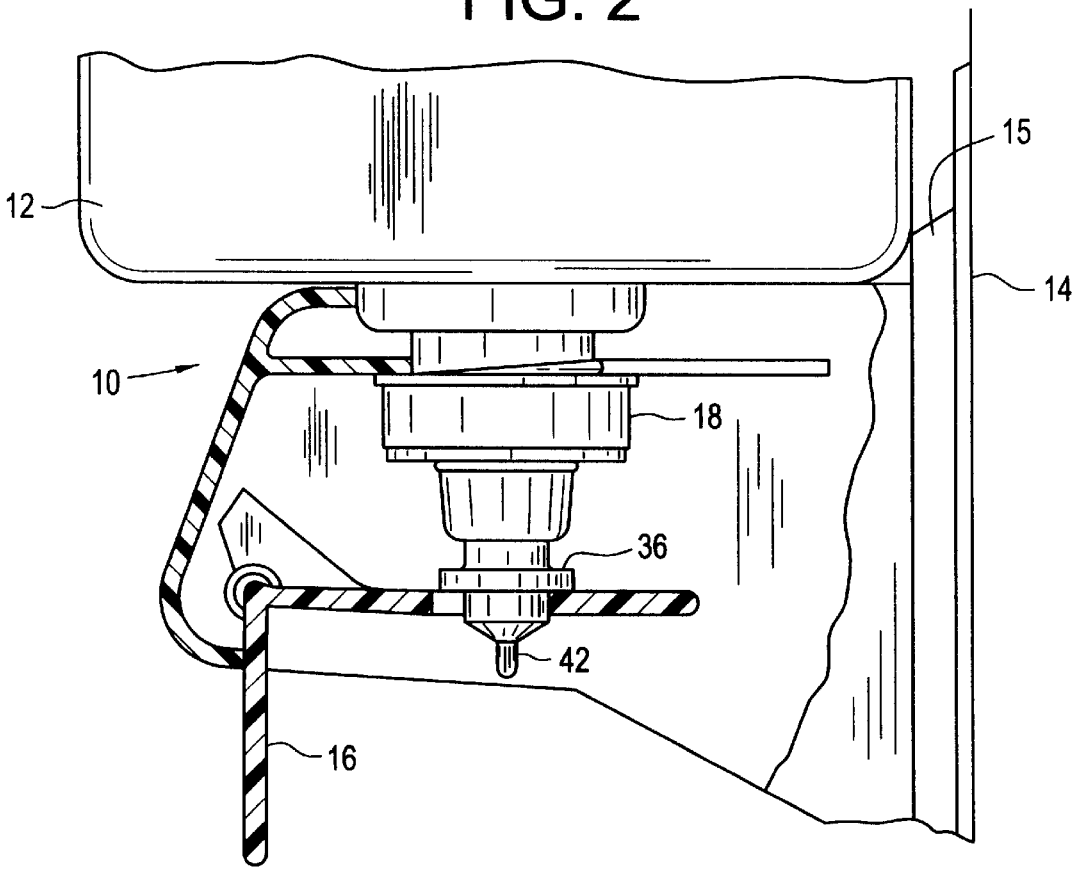
FIG. 2 is a view showing the fluid dispenser of FIG. 1 installed in a fluid container and container holder.

Referring to the drawings, first to FIGS. 1 and 2, there is generally indicated at 10 a fluid dispenser of this invention operable to dispense a fluid such as soap or lotion from a container 12. The dispenser 10 is applicable to a mouth of the container 12 with the container in an inverted position and the mouth down. The container 12 is mounted on a wall 14 or other suitable support surface by means of a container holder 15 and includes a lever 16 for actuating the dispenser 10 (FIG. 2). The dispenser 10 is fitted within a cap 18 which is threaded onto the container 12 over the mouth for dispensing the fluid. The dispenser 10 is movable in an upward direction relative to the inverted container 12 through a pressure stroke for delivering a charge of fluid to a user and in a downward direction relative to the inverted container through a return stroke to a dispenser recharging position.

The preferred embodiment of the dispenser 10, as shown in FIGS. 1–6, includes a body, generally indicated at 20 formed of resilient elastomeric material having a hollow annular upper part having a flexible, resilient annular wall and an upper and lower end and constituting a bellows 22 which is downwardly expansible and upwardly contractible by flexing of the annular wall. The valve further includes a first check valve, generally indicated at 24, for drawing fluid into the bellows 22 from the container and a second check valve, generally indicated at 26, allowing flow therethrough upon pressurization of the bellows 22 for dispensing the charge of fluid. Following the discharge of the charge of fluid from the bellows 22, the chamber is refilled with fluid from the container 12 and the dispenser 10 is ready to discharge another charge of fluid.

Figure 3:
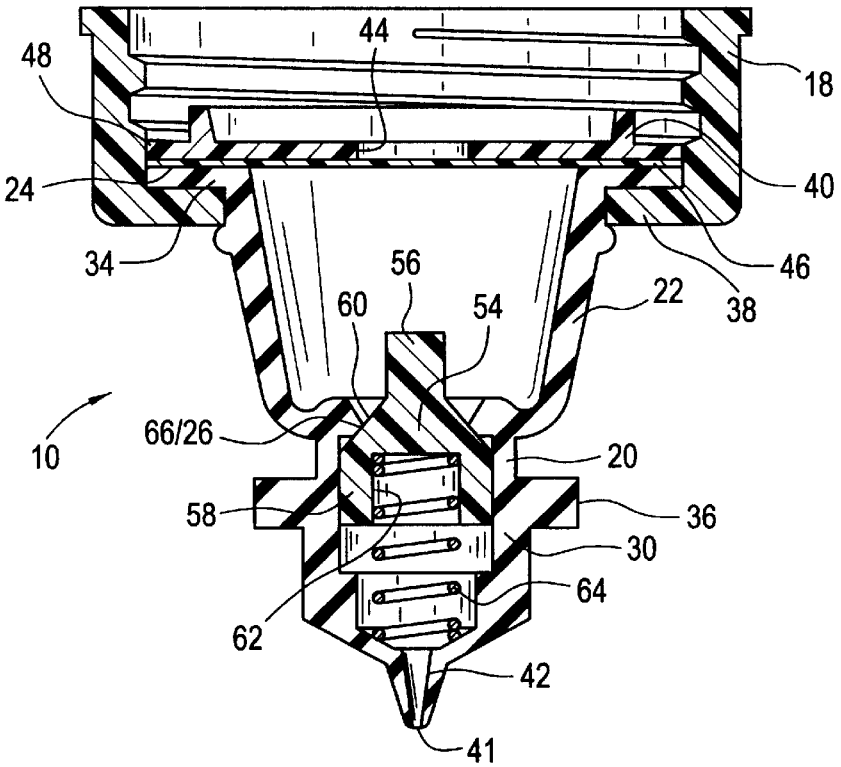
FIG. 3 is a cross-sectional view of the fluid dispenser of FIG. 1.
Figure 4:
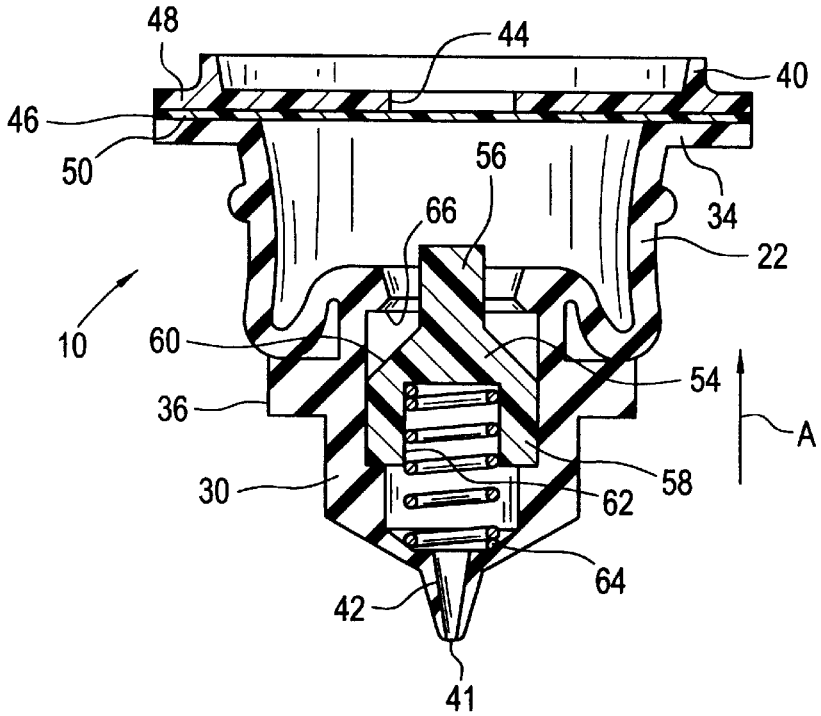
FIG. 4 is a cross-sectional view of the fluid dispenser valve of FIG. 1 shown in a fluid dispensing position.
Figure 5:
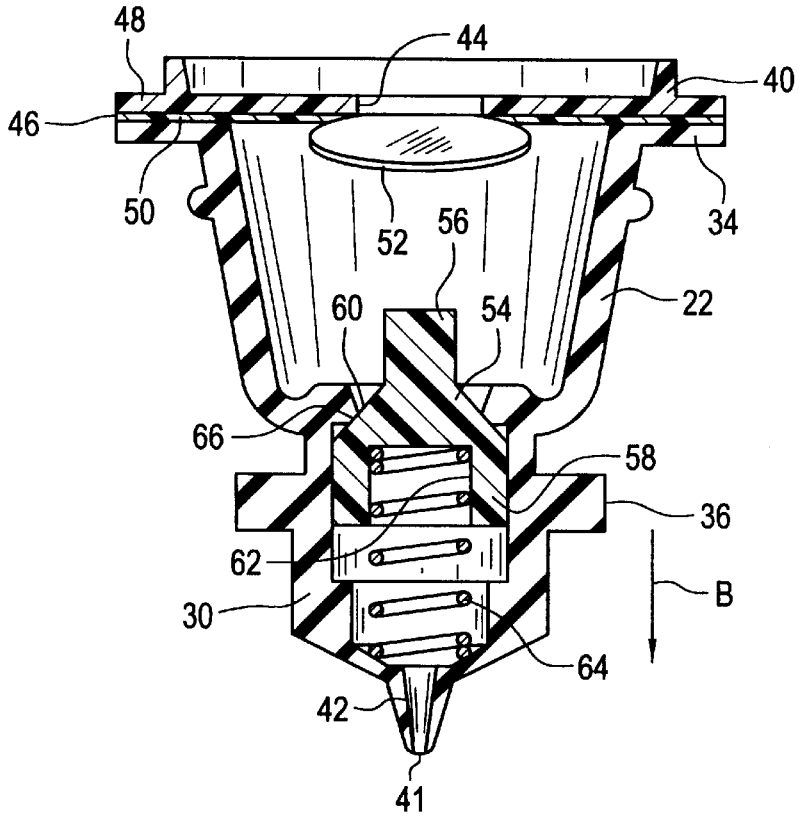
FIG. 5 is a cross-sectional view of the fluid dispenser valve of FIG. 1 shown in a fluid recharging position.
Figure 6:
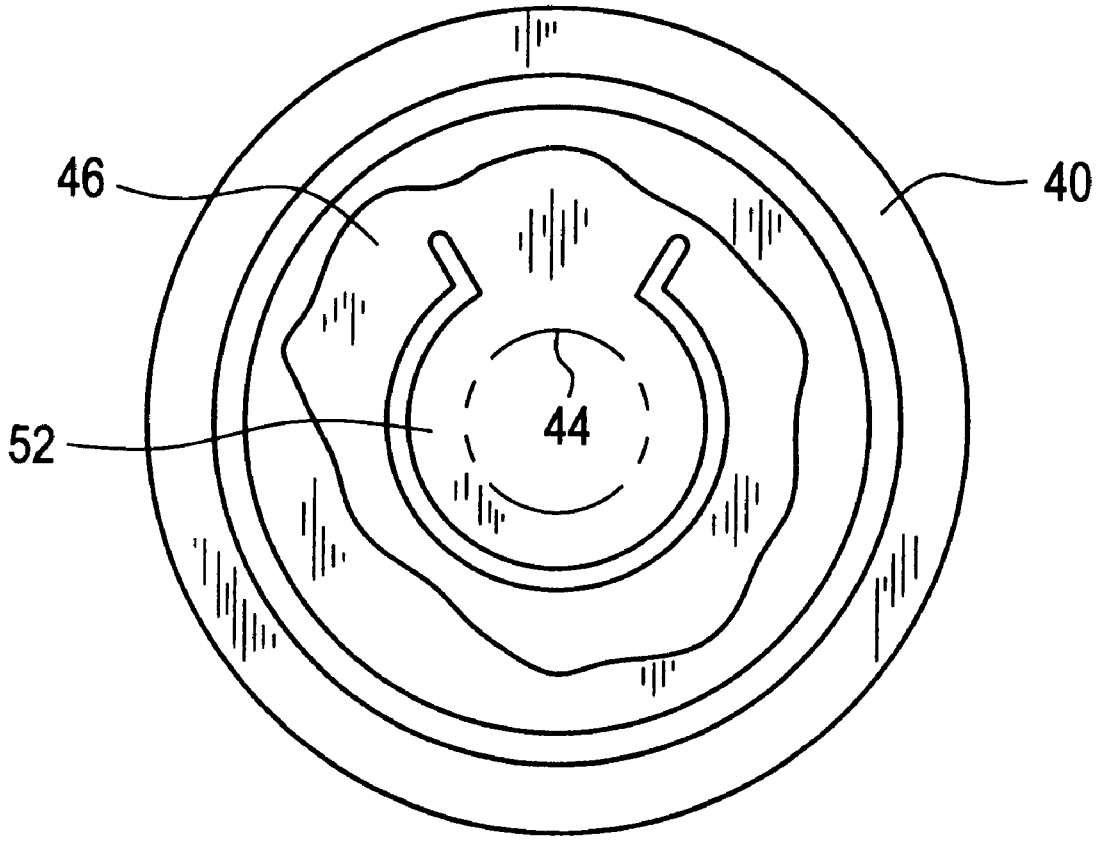
FIG. 6 is a top view of the first check valve.

The body 20 is preferably formed from a resilient elastomeric material such as rubber vinyl or any other suitable material so that the annular wall of the body is compressible and expandable. The body 20 has an inlet 28 for receiving fluid from the container 12 and an outlet port 42 for discharge of the charge of fluid. As shown in FIG. 3, the body 20 includes a hollow central portion which defines the expansible bellows 22 for holding the charge of fluid. The bellows 22 is sized to hold a predetermined amount of fluid to be discharged upon each actuation of the lever 16. The body 20 further includes an upper flange 34 for engaging with the cap 18 of the container 12 for supporting the body 20 and a lower flange 36 for engaging with the lever 16 of the container for compressing the bellows 22 and discharging the fluid. The upper flange 34 rests on a bottom flange 38 of the cap 18. It is to be understood that the cross-sectional shape of the bellows 22 may vary as long as the volume is sufficient to hold an adequate amount of fluid to be discharged upon actuation of the lever 16. The body 20 further includes integral with the bellows 22 a lower part having a outlet port 42 of smaller cross-section than the lower end of the bellows, extending down from the lower end of the bellows and generally concentric therewith.

The body 20 further includes integral with the bellows 22 an outlet nozzle 30, extending down from the lower end of the bellows and generally concentric therewith. The outlet nozzle 30 includes an outlet port 42. The interface between the bellows 22 and the outlet nozzle 30 forms part of the second check valve 26 which will be described further below.

The first check valve 24 allows fluid to be transferred from the container 12 into the body 20 upon expansion of the bellows 22. When the bellows 22 is full of fluid the first check valve 24 is in its closed position. Following discharge of the charge of fluid from the bellows 22, vacuum pressure is developed in the chamber as the body 20 expands to its original uncompressed position. The vacuum pressure forces open the first check valve 24, thereby drawing fluid through the first check valve to refill the bellows 22 in preparation for the next discharge of fluid. The first check valve 24 comprises a first valve seat 40 containing at least one opening 44 for allowing flow therethrough and a flexible cantilevered disc 46 extending over the opening and movable toward the opening for preventing flow through the opening when the first check valve is in a closed position and movable away from the port for allowing flow through the port when the first check valve is in an open position. The first valve seat 40 includes a generally flat circular plate 48 having a bottom surface 50 facing the bellows 22. The plate 48 is positioned over the upper flange 34 of the body 20 and the bottom of the container 12. The plate 48 includes a central opening 44 forming the port of the first check valve 24. The plate 48 is preferably formed from a polymeric material but may also be formed from other suitable rigid materials. It is to be understood that the number and shape of openings 44 formed within the plate 48 can vary without departing from the scope of this invention. The flexible cantilevered disc 46 comprises a flap 52 which is normally seated against the bottom surface 50 of the plate 48 and resting over the central opening 44 in the plate. The flap 52 has a diameter slightly larger than the diameter of the central opening 44 to prevent the flap from being forced through the central opening when being forced against the central opening by the pressure created within the bellows 22 as the body 20 contracts.

The second check valve 26 comprises a poppet valve, generally indicated at 54. The poppet valve 54 has a narrow head 56 formed to extend axially from the wider trunk 58 of the poppet valve. Between the head 56 and the trunk 58, the poppet valve sealing surface 60 conically connects the trunk 58 and the head 56. The trunk 58 has a cavity 62 formed in its bottom portion where the upper end of a bias spring 64 pushes the poppet valve 54 up such that the poppet valve sealing surface 60 is pressed against the second valve seat 66 integrally formed into the body 20. The lower end of the bias spring 64 seats against the interior of the outlet nozzle 30. When the bellows 22 is pressurized such that the pressure on the poppet valve 54 overcomes the force of the bias spring 64, the second check valve 26 will open, allowing the fluid to flow from the bellows 22 to the outlet nozzle 30. This fluid will displace the fluid already in the outlet nozzle 30 thereby ejecting fluid from the dispenser 10. When the bellows 22 expands from its collapsed position the poppet valve 54 shuts due to the lack of adequate pressure in the bellows, a vacuum is created in the bellows, and the first check valve 24 opens.

In operation, the body 20 is pressed upwardly by counterclockwise movement of the lever 16. This movement compresses the expansible bellows 22 and the resultant pressure created in the bellows closes the first check valve 24 and opens the second check valve 26, discharging the fluid contained in the bellows through the exit orifice 41 of the body 20. When the lever 16 is released, the body 20 expands back to its original position under the inherent bias due to it being elastomeric, the second check valve 26 is closed and the vacuum pressure created within the body opens the first check valve 24 allowing fluid to flow through the openings 44 and fill the bellows 22. With each cycle the bellows 22 is filled with a predetermined amount of fluid.

In view of the above, it will be seen that the several objects of the invention are achieved and other advantageous results attained.

As various changes could be made in the above constructions without departing from the scope of the invention, it is intended that all matter contained in the above description and shown in the accompanying drawings shall be interpreted as illustrative and not in a limiting sense.

What is claimed is:

1. A dispensing valve assembly connectable to a container for dispensing fluid from the container, the valve assembly comprising:

a bellows capable of movement between an expanded configuration and a collapsed configuration, the bellows having an inlet for fluid communication with the container for receiving fluid into the bellows upon movement of the bellows to its expanded configuration and an outlet for exhausting fluid from the bellows upon movement of the bellows to its collapsed configuration;

an outlet nozzle connected to the bellows in fluid communication with the outlet of the bellows for receiving fluid exhausted from the bellows and dispensing fluid from the dispenser the outlet nozzle including an exit orifice for dispensing fluid from the dispenser, the fluid dispensed being in direct contact with the exit orifice;

the bellows, the outlet nozzle and the exit orifice being of unitary construction and formed of an elastomeric material;

a first check valve for regulating the flow of fluid between the container and the bellows; and a second check valve for regulating the flow of fluid between the bellows and the outlet nozzle.

2. A dispensing valve assembly as set forth in claim 1 wherein an outlet port formed at a distal end of the outlet nozzle is formed in a predetermined size related to the viscosity of the fluid to be dispensed.

3. A dispensing valve assembly as set forth in claim 1 wherein the first check valve comprises a first valve seat, the first valve seat being formed of a rigid material with a single opening, and a cantilevered disc, the cantilevered disc being formed of a flexible material capable of sealing and unsealing the opening by resting against the first valve seat.

4. A dispensing valve assembly as set forth in claim 3 wherein the cantilevered disc is constructed with at least one groove, the groove forming at least one flap substantially centrally located on the cantilevered disc for pivoting freely, thereby sealing and unsealing the opening by resting against the first valve seat.

5. A dispensing valve assembly as set forth in claim 3 wherein the first check valve acts as a seal between the container and the valve assembly.

6. A dispensing valve assembly as set forth in claim 1 wherein the first check valve is constructed to be placed between the container and the valve assembly and held by a fastening means for holding the container and the valve assembly together.

7. A dispensing valve assembly as set forth in claim 6 wherein the first check valve is constructed to be self aligning between the container and valve assembly.

8. A dispensing valve assembly as set forth in claim 1 wherein the second check valve is comprised of a poppet valve.

9. A dispensing valve assembly as set forth in claim 8 wherein the poppet valve sealing surface is formed with a chamfer to improve the sealing capability of the valve.

10. A dispensing valve assembly as set forth in claim 9 wherein a poppet valve head extends axially from the poppet valve to enhance the assembly of the second check valve by providing a piece to grip during insertion of the poppet valve.

11. A dispensing valve assembly as set forth in claim 8 wherein the poppet valve is biased against a second valve seat by means of a compression spring thereby creating a seal between the bellows and the outlet nozzle.

* * * * *